US005934892A

United States Patent [19]

Rabovitser et al.

[11] Patent Number: 5,934,892

[45] Date of Patent: Aug. 10, 1999

[54] PROCESS AND APPARATUS FOR EMISSIONS REDUCTION USING PARTIAL OXIDATION OF COMBUSTIBLE MATERIAL

[75] Inventors: Iosif K. Rabovitser, Skokie; Mark J. Khinkis, Morton Grove; Michael J. Roberts, Naperville, all of Ill.

[73] Assignee: Institute of Gas Technology, Des Plaines, Ill.

[21] Appl. No.: 09/130,040

[22] Filed: Aug. 6, 1998

[51] Int. Cl.[6] ..... F23M 3/04

[52] U.S. Cl. ..... 431/10; 431/8; 431/9; 431/190; 431/174

[58] Field of Search ..... 431/10, 9, 8, 173, 431/174, 190

[56] References Cited

U.S. PATENT DOCUMENTS

| | | | |
|---|---|---|---|
| 3,052,287 | 9/1962 | Shirley | 431/10 |
| 4,007,001 | 2/1977 | Schirmer et al. . | |
| 4,021,188 | 5/1977 | Yamagishi et al. . | |
| 4,335,660 | 6/1982 | Maloney et al. . | |
| 4,438,705 | 3/1984 | Basic, Sr. . | |
| 4,505,666 | 3/1985 | Martin et al. . | |
| 4,516,510 | 5/1985 | Basic, Sr. . | |
| 4,759,340 | 7/1988 | Chong . | |
| 4,879,959 | 11/1989 | Korenberg . | |
| 4,920,925 | 5/1990 | Korenberg et al. . | |
| 4,989,549 | 2/1991 | Korenberg . | |
| 5,020,456 | 6/1991 | Khinkis et al. . | |
| 5,105,747 | 4/1992 | Khinkis et al. . | |
| 5,139,755 | 8/1992 | Seeker et al. . | |
| 5,161,471 | 11/1992 | Piekos . | |
| 5,176,513 | 1/1993 | Zinn et al. . | |
| 5,205,227 | 4/1993 | Khinkis et al. . | |
| 5,209,187 | 5/1993 | Khinkis . | |
| 5,220,888 | 6/1993 | Khinkis et al. . | |
| 5,307,746 | 5/1994 | Khinkis et al. . | |
| 5,441,403 | 8/1995 | Tanaka et al. . | |
| 5,462,430 | 10/1995 | Khinkis . | |
| 5,584,684 | 12/1996 | Dobbeling et al. | 431/9 |

*Primary Examiner*—Carroll B. Dority
*Attorney, Agent, or Firm*—Pauley Petersen Kinne & Fejer

[57] ABSTRACT

A process for combustion of a combustible material in which a primary combustible material is introduced into a combustion chamber having an upstream region and a downstream region, and ignited, forming a primary combustion zone. A secondary combustible material is partially combusted in a partial combustor, forming partial combustion products which are then injected into the combustion chamber downstream of the primary combustion zone, forming an oxygen deficient zone downstream of the primary combustion zone.

22 Claims, 3 Drawing Sheets

PROCESS AND APPARATUS FOR EMISSIONS REDUCTION USING PARTIAL OXIDATION OF COMBUSTIBLE MATERIAL

BACKGROUND OF THE INVENTION

1. Field of the Invention

This invention relates to a combustion process and apparatus for emissions reduction, in particular $NO_x$ emissions reduction, from the combustion of a combustible material in a combustion chamber of a heating device such as a boiler or water heater. More particularly, this invention relates to a process and apparatus for combustion of a combustible material in a combustion chamber wherein a primary combustion zone is formed and a fluid is introduced into the combustion chamber downstream of the primary combustion zone producing an oxygen deficient zone which reduces any undesirable $NO_x$ and/or $NO_x$ precursors to harmless molecular nitrogen.

2. Description of Prior Art

Conventional combustion of combustible materials with air in industrial heating devices such as water heaters and boilers typically produces elevated temperatures which promote complex chemical reactions between oxygen and nitrogen in the air or in the fuel, forming various oxides of nitrogen as by-products of the combustion process. These oxides, containing nitrogen in different oxidation states, generally are grouped together under the single designation of $NO_x$. Concern over the role of $NO_X$ and other combustion by-products, such as sulphur dioxide and carbon monoxide, in "acid rain" and other environmental problems is generating considerable interest in reducing the formation of these environmentally harmful by-products of combustion.

Toward this end, there exist numerous methods and apparatuses which are designed to reduce undesirable emissions, such as $NO_x$, from the combustion process. One such general methodology is the use of staged combustion in which elements for combustion are introduced in stages, such as into multiple combustion chambers, for combustion of a fuel. For example, U.S. Pat. No. 5,462,430 to Khinkis teaches a process and apparatus for cyclonic combustion with ultra-low pollutant emissions and high efficiency in which a fuel and primary combustion air mixture is tangentially injected into a reducing primary combustion zone of a cyclonic combustor. Secondary combustion air is then tangentially injected into an oxidizing secondary combustion zone of the cyclonic combustor where it mixes with primary combustion products from the reducing primary combustion zone. See also U.S. Pat. No. 5,209,187 to Khinkis which teaches a low pollutant-emission, high efficiency cyclonic burner for fire tube boilers and heaters in which the combustion air required for complete combustion is introduced into the burner in stages, and U.S. Pat. 5,441,403 to Tanaka et al. which teaches a method of low $NO_x$ combustion in which a primary fuel is injected from a periphery of a stream of combustion air toward the combustion air, thereby effecting a first combustion and creating a generally cylindrical primary flame covering the combustion air, and a secondary fuel is injected towards the combustion air, shielded by the primary flame from the combustion air while causing $NO_x$ in the primary flame to be reduced by the secondary fuel, after which the secondary fuel contacts a portion of the combustion air by penetrating through the primary flame at a downstream side thereof so as to effect a second combustion.

Staged combustion is also taught by U.S. Pat. No. 4,989,549 to Korenberg which teaches a combustion apparatus for staged combustion inside a Morison tube of a fire tube boiler in which the first combustion stage is sub-stoichiometric and the second stage is above stoichiometric; U.S. Pat. No. 4,505,666 to Martin et al. which teaches a low $NO_x$ burner for a furnace and a method for operating the burner involving a primary and secondary combustion zone in which staged fuel and air is provided to both combustion zones; U.S. Pat. No. 4,007,001 to Schirmer et al. which teaches a method of combustion for lowering emissions of nitrogen oxides and carbon monoxide in which a first stream of air is introduced into a first combustion zone of a combustor, a second stream of air is introduced tangentially into the first combustion zone, and a third stream of air is introduced tangentially into a second combustion zone of the combustor; and U.S. Pat. No. 4,021,188 to Yamagishi et al. which teaches a burner configuration for staged combustion in which a fuel-rich mixture of hydrocarbon fuel and air are introduced into a combustion chamber having a path for secondary air around the combustion chamber, a flame holding means in one end of the combustion chamber stabilizes the sub-stoichiometric combustion so that a partially burned gas containing mainly hydrogen and carbon monoxide as combustible components is obtained, and as the partially burned gas is discharged from the combustion chamber, secondary air is discharged in a pattern surrounding the partially burned gases exiting the combustion chamber so as to complete combustion.

U.S. Pat. No. 4,879,959 to Korenberg teaches a swirl combustion apparatus in which a peripheral swirl of air is supplied into a combustion chamber adjacent to the inner surface of a cylindrical wall, and partially pre-burned fuel is supplied from a pre-combustion chamber to the combustion chamber to mix with the swirl of air, burn in the combustion chamber, and form hot combustion gases.

Processes and apparatuses for emissions reduction from waste incineration in which a reducing/oxygen deficient secondary combustion zone is formed downstream of a primary combustion zone are taught by U.S. Pat. No. 5,020,456, U.S. Pat. No. 5,105,747, U.S. Pat. No. 5,205,227, and U.S. Pat. No. 5,307,746, all to Khinkis et al. Each of the disclosed processes and apparatuses utilizes the introduction of one or more of a fuel, a fuel/carrier fluid, fuel/recirculated flue gases, or the output of a calciner comprising combustion products and a calcined sorbent downstream of the primary combustion zone to form the desired reducing oxygen deficient secondary combustion zone.

Flue gas recirculation in boilers and furnaces is a technique generally known to those skilled in the art for reducing emissions from combustion processes. The use of flue gas recirculation typically involves the introduction of flue gases into a combustion chamber within a boiler or furnace above a burning fuel bed, that is, downstream of a primary combustion zone. This continual recycling of the flue gas results in a further burning of smoke and other particulate matter contained therein. In addition, the formation of various nitric and nitrous oxides and carbon monoxide gases in the flue gas is reduced, thereby minimizing the release of these undesirable gases into the atmosphere. In some instances, flue gas recirculation is also used under the grate which supports the burning fuel bed for coal-fired stoker boilers. Flue gas recirculation under the grate has been applied to coal-fired stoker boilers for a number of years as evidenced by Maloney, K. L., "Recycle Flue Gas to Cut Emissions, Improve Boiler Performance," Power, pages 97–99, June 1983, U.S. Pat. No. 4,335,660, and U.S. Pat. No. 5,020,456, U.S. Pat. Nos. 5,105,747, 5,205,227, and 5,307,746 to Khinkis et al. as discussed hereinabove.

One of the drawbacks of flue gas recirculation is the requirement of a large quantity of completely combusted gases for injection into the furnace to promote mixing and help make the temperature profile more uniform, which large volume of gases then must be removed from the exhaust. Depending on the removal location, this combusted gas may contain large quantities of particulate which may cause erosion and corrosion in the duct work of conventional systems. An additional problem is the presence of oxygen in the exhaust gases. This oxygen, when present in the furnace, diminishes the net effect of the reducing atmosphere.

For applications in which fuel is introduced into a combustion chamber downstream of a primary combustion zone to form a reducing secondary combustion zone, a technique known as "reburn," the volume of fuel introduced in this manner is generally so low compared to the total volume of combustion products from the primary combustion zone that mixing of the fuel uniformly therein is difficult, thereby requiring special injection techniques for enhancing mixing, or the use of a carrier fluid, such as flue gases, steam, water, air, and/or nitrogen, the resulting increase of volume enhancing the mixing and improving the temperature and composition uniformity within the combustion chamber. At least one disadvantage of this technique is the requirement of additional hardware, such as blowers, duct work, piping, etc. which increase the capital cost to retrofit a furnace for $NO_x$ reduction. In addition, there is considerably more maintenance cost associated with such a reburn system, and operating expenses are also higher, particularly where flue gas recirculation is employed, due to the large blower and blower motor requirements which consume considerable quantities of electricity. See also U.S. Pat. No. 5,176,513 which teaches a pulse combustor apparatus in which air or a gaseous, low nitrogen fuel for air staging or reburning is introduced into a combustion zone downstream of a primary combustion zone; U.S. Pat. No. 5,161,471 which teaches an apparatus for reburning ash material of a previously burned primary fuel in which combustion air is introduced at a level above a primary combustion zone; U.S. Pat. No. 5,139,755 which teaches a combustion process for reducing $NO_x$ emissions in which a reburned fuel is mixed with combustion emissions in a gaseous reburn zone so as to produce a substantially oxygen deficient reburn zone; U.S. Pat. No. 4,759,340 which teaches a fire grate having air delivery passages for supplying fresh air directly to the top of the grate for assistance in reburning volatile products; and U.S. Pat. No. 4,516,510 and related U.S. Pat. No. 4,438,705, both of which teach a method of incineration in a main combustion chamber having two consecutive reburn stages.

SUMMARY OF THE INVENTION

It is one object of this invention to provide a method for combustion of a combustible material which limits and/or reduces $NO_x$ emissions.

It is another object of this invention to provide a process for combustion of a combustible material which limits and/or reduces $NO_x$ emissions and which avoids the need for flue gas recirculation and the blower and duct work associated therewith, thereby reducing capital costs associated with retrofitting combustion equipment for $NO_x$ reduction.

It is yet another object of this invention to provide a method and apparatus for combustion of a combustible material which results in substantially lower maintenance costs and operating expenses compared to conventional systems utilizing flue gas recirculation.

It is another object of this invention to provide a method and apparatus for combustion of a combustible material which limits and/or reduces $NO_x$ emissions therefrom and which avoids the utilization of carrier fluids, such as steam, water, nitrogen and/or recirculated flue gases in a reburn zone downstream of a primary combustion zone for enhancing mixing, and improving temperature and combustion uniformity in the rebum zone.

These and other objects are accomplished in accordance with one embodiment of this invention by a process in which a first combustible material is introduced into a combustion chamber having an upstream region and a downstream region and ignited, forming a primary combustion zone, a second combustible material, which may be the same as the first combustible material, is partially combusted in a partial combustor, separate and apart from the combustion chamber, forming partial combustion products, and the partial combustion products are injected into the combustion chamber downstream of the primary combustion zone, forming an oxygen deficient zone downstream of the primary combustion zone. The partial combustion products, formed for example by combustion of a fuel, such as natural gas, with a suitable oxidant at a stoichiometric ratio (air/fuel) of about 0.3 to about 0.9, are fuel-rich and contain reducing gases such as hydrogen, carbon monoxide and radicals such as $CH_2$ and other gases such as $CO_2$, $H_2O$, $N_2$, soot, and virtually no oxygen. This hot reducing gas mixture of partial combustion products is injected into the furnace to create an oxygen deficient zone while introducing suitable active species to reduce $NO_x$ and $NO_x$ precursors to harmless molecular nitrogen. Partial combustion, particularly in the case of natural gas, should occur at least above about 1200° F.

Thus, in contrast to conventional methods and apparatuses which require the recirculation of flue gases for reduction of $NO_x$ emissions, the present invention provides for direct, partial combustion, the resultant products of which contain virtually no oxygen due to the fact that the precombustion mixture is fuel-rich. In addition, because the gases are injected directly into the furnace after combustion, the gas temperature is relatively high and the corresponding gas volume is high, which promotes mixing and uniform distribution in the combustion chamber.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
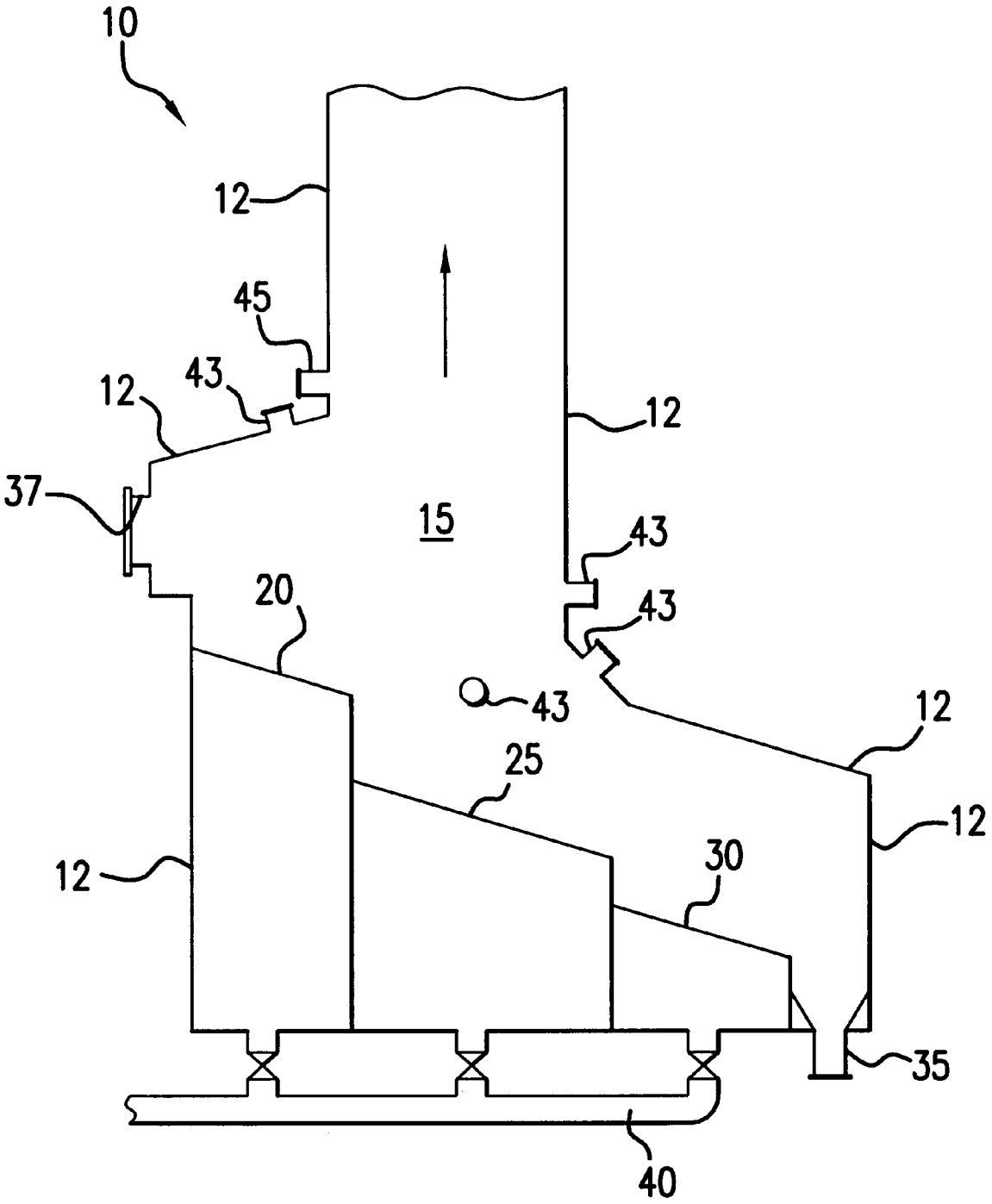
FIG. 1 shows a diagrammatic cross-sectional front view of a furnace for combustion of combustible material in accordance with one embodiment of this invention.

As used in the specification and claims, "$NO_x$" refers to oxides of nitrogen or nitrogen oxides, such as NO, $NO_2$, and $N_2O$. The "primary combustion zone" is the zone in which combustion of the combustible material occurs. In the exemplary embodiment of a furnace suitable for carrying out the process of this invention, a stoker furnace as shown in FIG. 1, the primary combustion zone is disposed immediately above the combustion grate. The "secondary combustion zone", also referred to as the "oxygen deficient zone" or "reburn zone", is the volume of the combustion chamber disposed downstream of the primary combustion zone into which products of combustion from the primary combustion zone flow. The "tertiary combustion zone" is the volume of combustion chamber downstream of the secondary combustion zone into which derivative combustion products from the secondary combustion zone flow. The term "combustible material" as used in the specification and in the claims means any suitable material, including solid fuels, liquid fuels, gaseous fuels, and mixtures thereof, which can be burned. Without intending to limit its scope in any manner, "combustible material" used in the process and apparatus of this invention may also include municipal solid waste, refuse derived fuel, and/or other comparable solid waste. Finally, the term "oxygen deficient" as used throughout this specification and in the claims means the presence of insufficient oxygen to promote the formation of $NO_x$ in the presence of nitrogen or nitrogen-containing compounds.

Accordingly, an exemplary embodiment of an apparatus for combustion of combustible material in accordance with one embodiment of this invention, furnace 10, is shown in a diagrammatic cross-sectional front view in FIG. 1. A plurality of walls 12 define combustion chamber 15. A stoker grate positioned within combustion chamber 15, preferably in a lower portion thereof, comprises at least one drying grate portion 20, at least one combustion grate portion 25, and at least one burnout grate portion 30. It will be apparent to those skilled in the art that other grate configurations are equally suitable and that other combustion chamber configurations, including combustion chambers without a stoker grate, may be utilized to carry out the process of this invention. At least one ash pit outlet 35 is located within combustion chamber 15, positioned to receive ash from burnout grate portion 30. At least one combustible material inlet means 37 is positioned in wall 12 above the grate such that the combustible material enters combustion chamber 15 and flows onto drying grate portion 20. The combustible material is advanced by combustible material advancement means from drying grate portion 20, over combustion grate portion 25, over burnout grate portion 30, and into ash pit outlet 35.

Undergrate air supply means comprises at least one undergrate air conduit 40 in communication with an undergrate air source and a space beneath at least one of drying grate portion 20, combustion grate portion 25, and burnout grate portion 30. Undergrate air conduit 40 is used to supply undergrate air beneath and then through the grate. An undergrate air source and at least one space beneath the stoker are in communication with undergrate air conduit 40 and are also used to provide undergrate air beneath and then through the grate. Undergrate air is the primary source of air for combustion of combustible material in combustion chamber 15. Combustion of the combustible material occurs in combustion chamber 15 primarily in the vicinity immediately above combustion grate portion 25, forming a primary combustion zone.

Figure 4:
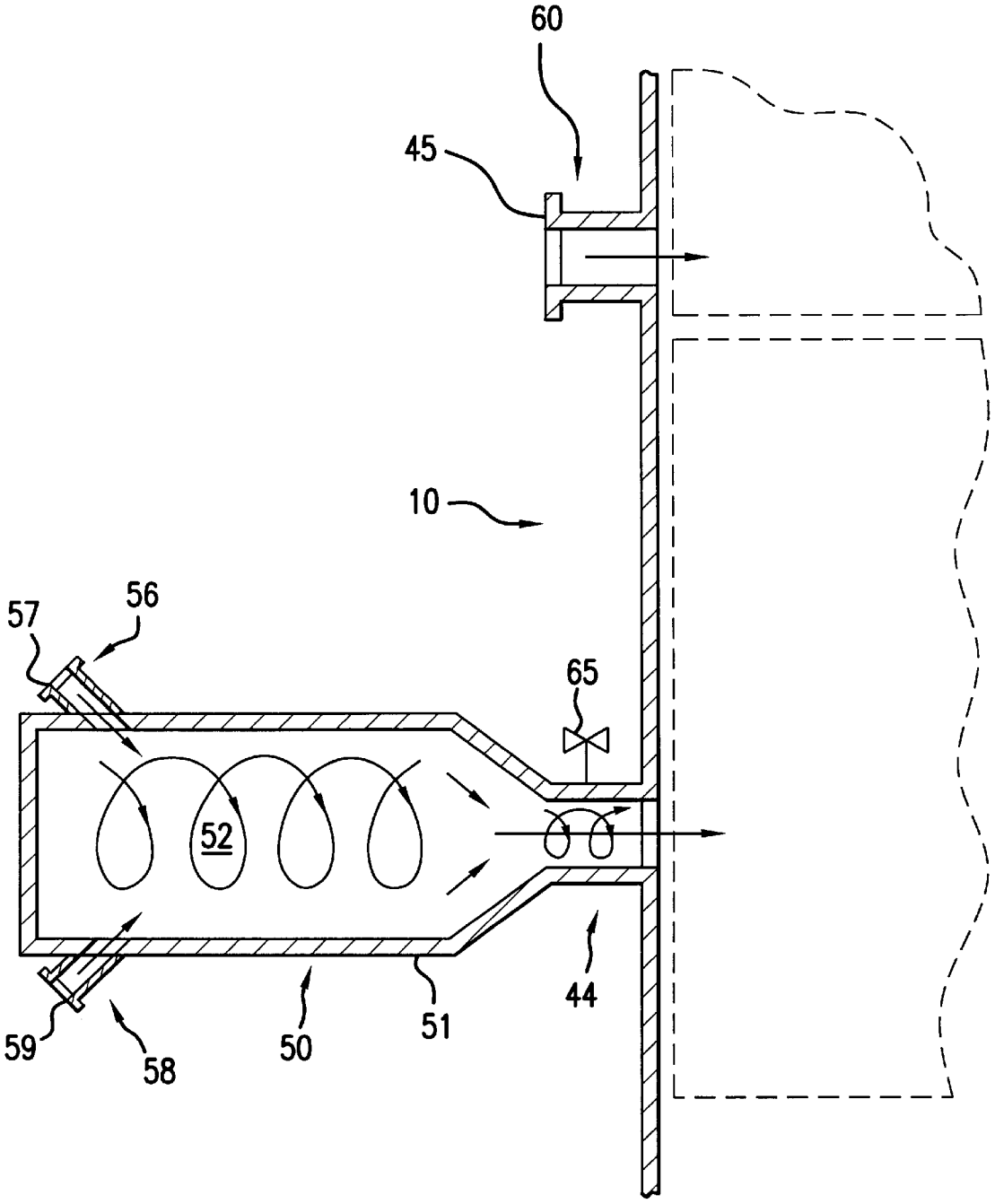
FIG. 4 is a cross-sectional view of a furnace wall section showing a partial combustor according to one embodiment of this invention.

At least one partial combustion product inlet means 44 is secured to wall 12 and in communication with combustion chamber 15 as shown in FIG. 4. Partial combustion product inlet means 44 can include at least one partial combustion product inlet nozzle 43 secured to wall 12 and in communication with combustion chamber 15. Partial combustion products from partial combustor 50, typically comprising reducing gases such as hydrogen, carbon monoxide, and radicals such as $CH_2$ and other gases such as $CO_2$, $H_2O$ , $N_2$, and virtually no oxygen, are injected into combustion chamber 15 through partial combustion products nozzle 43 creating an oxygen deficient secondary combustion zone immediately downstream of the primary combustion zone into which combustion products from the primary combustion zone flow. Partial combustion products are produced in partial combustor 50 by the combustion of a fuel at a stoichiometric ratio in the range of about 0.3 to about 0.9 (air/fuel). To avoid the addition of nitrogen to the system of combustion products generated in the primary combustion zone, the combustible material used in the generation of the partial combustion products is preferably a combustible material containing relatively insignificant fuel-bound nitrogen selected from the group consisting of a solid fuel, a liquid fuel, a gaseous fuel, and mixtures thereof. A particularly suitable fuel for this purpose, in accordance with one preferred embodiment of this invention, is natural gas. The stoichiometric ratio of air/fuel utilized by partial combustor 50 in the formation of partial combustion product is variable within the range of about 0.3 to about 0.9 depending upon the oxygen content of the products of combustion in the region of combustion chamber 15 downstream of the primary combustion zone. In particular, the stoichiometric ratio should be such that the mixing of the partial combustion products with the products of combustion from the primary combustion zone results in an oxygen deficient secondary combustion zone. The temperature of the partial combustion products from partial combustor 50 is preferably greater than about 1200° F., but in any event is sufficient to produce a temperature in the oxygen deficient secondary combustion zone in the range of about 1600° F. to about 2400° F.

At least one overfire air means 60 is secured to wall 12 and in communication with combustion chamber 15. Overfire air means can include an overfire air nozzle 45 secured to wall 12 and in communication with combustion chamber 15. Each overfire air nozzle 45 is secured to wall 12 in such a position that air, or any suitable oxidizing fluid, is injected into combustion chamber 15 downstream of the oxygen deficient secondary combustion zone. In accordance with one preferred embodiment of this invention, each overfire air nozzle 45 and each partial combustion products nozzle 43 is either positioned, or has internal mechanical components known in the art, for tangentially or radially injecting their respective fluids into combustion chamber 15. It will be apparent that internal baffles, internal or external nozzles, or the like, can be used to tangentially or radially direct the fluid into combustion chamber 15. Thus, in accordance with one embodiment of this invention, fluid swirl which enhances mixing can be accomplished in combustion chamber 15 having any type of cross section, even a rectangular cross section as shown in FIG. 3.

Figure 2:
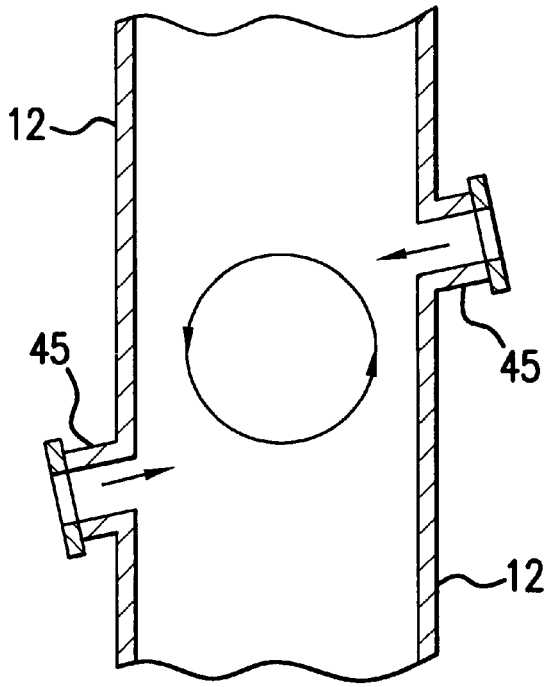
FIG. 2 shows a cross-sectional side view of an upper wall of the combustion chamber of FIG. 1 having nozzles secured at an angle with respect to the horizontal according to one embodiment of this invention.
Figure 3:
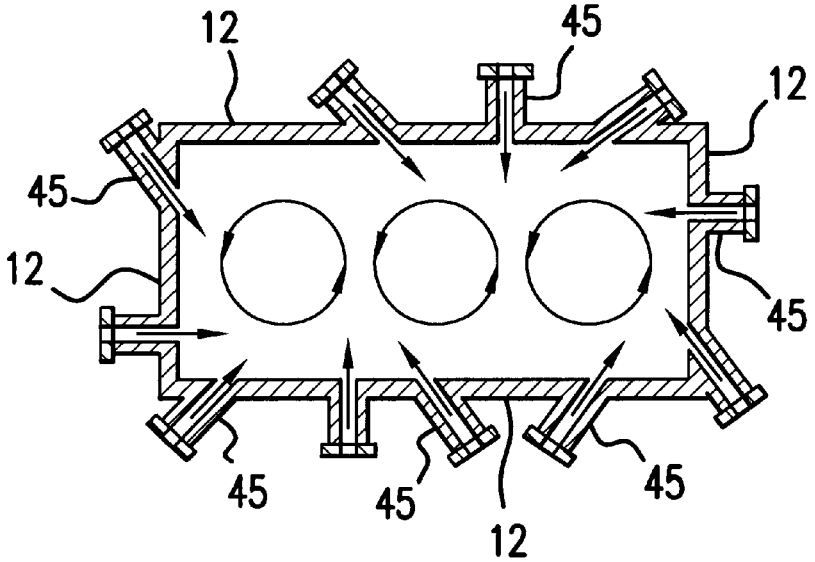
FIG. 3 shows a cross-sectional top view of the upper walls of the combustion chamber having secured nozzles that can be used to tangentially inject the fluid according to one embodiment of this invention.

Referring to FIG. 3, overfire air nozzle 45 can be positioned at angles relative to wall 12 such that at least one swirl, preferably multiple swirls, are formed within combustion chamber 15. It will be apparent to those skilled in the art that the fluid can be injected into combustion chamber 15 at an angle with respect to the horizontal by positioning overfire air nozzle 45 at an angle with respect to the horizontal, as shown in FIG. 2.

In accordance with one preferred embodiment of this invention, the temperature of the oxidizing tertiary combustion zone is in the range of about 1600° F. to about 2400° F. The amount of air or oxidant injected through overfire air nozzle 45 should be sufficient to provide preferably between about 5% and about 50% excess air within the oxidizing tertiary combustion zone to ensure completion of combustion of combustibles from the oxygen deficient, reducing secondary combustion zone.

FIG. 4 shows a cross-sectional view of partial combustor 50 in accordance with one embodiment of this invention. A first portion of hydrocarbon fuel, preferably natural gas, is mixed with combustion air and combusted in partial combustor 50. The first portion of hydrocarbon fuel is introduced into partial combustor 50 through hydrocarbon fuel inlet means 56. Hydrocarbon fuel inlet means 56 can include at least one hydrocarbon fuel inlet nozzle 57 secured to partial combustor wall 51 and in communication with partial combustion chamber 52. Combustion air is introduced into partial combustor 50 through combustion air inlet means 58 which can include at least one combustion air nozzle 59 secured to partial combustor wall 51 and in communication with partial combustion chamber 52. In accordance with one preferred embodiment of this invention, the hydrocarbon fuel injected into partial combustor 50 comprises between about 1% up to about 30% of the total amount of combustible material, based upon heating value, in combustion chamber 15. The temperature within partial combustor 50 is preferably greater than about 1200° F.

In accordance with one preferred embodiment of this invention, in order to promote the mixing of the partial combustion products from partial combustor 50 with the combustion products from the primary combustion zone to form the oxygen deficient secondary combustion zone downstream of the primary combustion zone, the partial combustion products are injected at a continuously variable flow rate into combustion chamber 15. This is accomplished, in accordance with one embodiment of this invention, by a variable flow device 65 disposed between the outlet of partial combustor 50 and partial combustion product inlet means 44. In accordance with one embodiment of this invention, the variable flow device is an electromechanical valve having a capability of operating in a range from filly open to fully closed. Accordingly, in accordance with one preferred embodiment of this invention, as a result of rapid opening and closing of the electromechanical valve, the partial combustion products from partial combustor 50 are introduced as pulses into combustion chamber 15. In accordance with another embodiment of this invention, the electromechanical valve is operated in a manner so as to rapidly vary the flow rate of partial combustion products into combustion chamber 15. In both instances, the result is the enhancement of mixing of the partial combustion products with the products of combustion from the primary combustion zone.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. A process for combustion of a combustible material comprising the steps of:

introducing a primary combustible material and an oxidant into a combustion chamber and igniting the primary combustible material, forming a primary combustion zone;

partially combusting a secondary combustible material in a partial combustor, forming partial combustion products;

introducing said partial combustion products into said combustion chamber downstream of said primary combustion zone, forming an oxygen deficient zone downstream of said primary combustion zone wherein products of combustion from said primary combustion zone mix with said partial combustion products; and introducing a burnout oxidant into said combustion chamber downstream of said oxygen deficient zone in a sufficient amount to complete combustion of any combustibles remaining in said combustion chamber downstream of said oxygen deficient zone.

2. A process in accordance with claim 1, wherein said secondary combustible material is a fuel containing relatively insignificant fuel-bound nitrogen selected from the group consisting of a solid fuel, a liquid fuel, a gaseous fuel, and mixtures thereof.

3. A process in accordance with claim 1, wherein said secondary combustible material is partially combusted at a stoichiometric ratio of about 0.3 to about 0.9.

4. A process in accordance with claim 1, wherein said partial combustion products have a temperature greater than about 1200° F.

5. A process in accordance with claim 1, wherein said partial combustion products comprise at least one chemically active species suitable for reducing at least one of $NO_x$ and $NO_x$ precursors to molecular nitrogen.

6. A process in accordance with claim 2, wherein said fuel is natural gas.

7. A process in accordance with claim 1, wherein said primary combustible material is selected from the group consisting of solid fuel, liquid fuel, gaseous fuel, and mixtures thereof.

8. A process in accordance with claim 1, wherein said primary combustion zone is an oxidizing zone.

9. A process in accordance with claim 1, wherein said partial combustion products are injected into said combustion chamber tangentially with respect to a combustion chamber wall.

10. A process in accordance with claim 1, wherein said partial combustion products are injected at a continuously variable flow rate into said combustion chamber.

11. A process in accordance with claim 1, wherein said partial combustion products are injected as pulses into said combustion chamber.

12. A process in accordance with claim 1, wherein said primary combustible material comprises in a range of about 75% to about 90% of a total amount of heat input into said combustion chamber.

13. A process in accordance with claim 1, wherein said secondary combustible material comprises in a range of about 10% to about 25% of a total amount of heat input into said combustion chamber.

14. A process in accordance with claim 1, wherein said primary combustible material and said oxidant are premixed.

15. A process in accordance with claim 1, wherein said primary combustible material and said secondary combustible material are the same.

16. A process in accordance with claim 1, wherein said primary combustible material and said secondary combustible material are different.

17. A furnace for combustion of a combustible material comprising:

at least one combustion chamber wall defining a combustion chamber having an upstream region and a downstream region;

combustible material inlet means for introducing a combustible material into said upstream region connected to said at least one combustion chamber wall; and partial combustion products means for introducing partial combustion products into said downstream region.

18. A furnace in accordance with claim 17, wherein said partial combustion products means comprises a partial combustor having a partial combustion products outlet in communication with said downstream region.

19. A furnace in accordance with claim 17 further comprising oxidant inlet means for introducing an oxidant into said combustion chamber downstream of said downstream region.

20. A furnace in accordance with claim 19, wherein said oxidant inlet means comprises at least one oxidant nozzle sealably secured to said at least one combustion chamber wall and in communication with said combustion chamber.

21. A furnace in accordance with claim 17, wherein said partial combustion products means further comprises flow means for varying a flow rate of said partial combustion products into said downstream region.

22. A furnace in accordance with claim 21, wherein said flow means comprises an electromechanical valve having a capability of operating in a range from fully open to fully closed.

* * * * *